US012532957B2

(12) United States Patent
Baldi

(10) Patent No.: US 12,532,957 B2
(45) Date of Patent: Jan. 27, 2026

(54) PINCER MECHANISM FOR TOTING A BEVERAGE BOTTLE OF A PERSONAL SIZE

(71) Applicant: Michael Owen Baldi, Walpole, MA (US)

(72) Inventor: Michael Owen Baldi, Walpole, MA (US)

( * ) Notice: Subject to any disclaimer, the term of this patent is extended or adjusted under 35 U.S.C. 154(b) by 9 days.

(21) Appl. No.: 18/429,653

(22) Filed: Feb. 1, 2024

(65) Prior Publication Data

US 2025/0248509 A1 Aug. 7, 2025

(51) Int. Cl.

| | |
|---|---|
| ***A45F 3/16*** | (2006.01) |
| ***A45F 5/02*** | (2006.01) |
| *A45F 5/00* | (2006.01) |

(52) U.S. Cl.

CPC ..... *A45F 5/021* (2013.01); *A45F 5/1583* (2025.01)

(58) Field of Classification Search

CPC ..... A45F 5/1583; A45F 3/16; A45F 5/021; A47G 29/18; B65D 23/104

USPC ..... 224/148.4

See application file for complete search history.

(56) References Cited

U.S. PATENT DOCUMENTS

| | | | | |
|---|---|---|---|---|
| 2,522,243 A * | 9/1950 | Wieland | B65G 7/12 294/99.2 |
| 8,240,525 B2 * | 8/2012 | Stojkovski | A45F 5/02 224/148.4 |
| 2012/0061433 A1 * | 3/2012 | Johnson | A45F 5/021 224/269 |

* cited by examiner

*Primary Examiner* — Adam J Waggenspack

(57) ABSTRACT

An inherently tensile self-adjusting pincer mechanism for toting a commercially manufactured beverage bottle of a personal size to provide an end user with a hands-free toting experience while further promoting a higher level of socially responsible behavior in the disposal, recycling, and/or the convenient reuse of a commercially manufactured beverage bottle.

2 Claims, 5 Drawing Sheets

PINCER MECHANISM FOR TOTING A BEVERAGE BOTTLE OF A PERSONAL SIZE

FIELD OF THE INVENTION

The present device improves the manner in which individuals can more swiftly and conveniently attach, detach, reposition, carry, tote, stow, and access the contents of a commercially made personally sized beverage bottle having a cast-in-place neck ring to further encourage that a used beverage bottle will not be abandoned, or otherwise irresponsibly trashed, but is either disposed of, or repurposed, in a most environmentally responsible way.

BACKGROUND AND SUMMARY OF THE INVENTION

Many of the hands-free devices currently available for toting a personally sized beverage bottle by utilizing the neck of a bottle as the means by which the device retains a bottle, are vexed with complaints. These complaints are primarily due to the various neck diameters that exist between commercially made beverage bottle manufacturers since these attributes are not standardized. As a result, these variations in neck size diameters subsequently cause toting devices of the current art to embody several shortcomings since;

1) Those types of toting devices which utilize rigidly-fixed prongs to tote a bottle are not universally practical. This is due to the aforementioned variation which exists between neck and neck ring diameters. Therefore, many bottles, subsequent to being loaded onto a rigidly-fixed prong device with a similarly rigid opening, tend to become easily dislodged when subjected to a jostling and/or an upward thrusting force. Therefore, the diminished retention capabilities of these types of devices renders this class to be less desirable to the consumer, which in turn discourages the consumer from investing in the device with only a limited use, thus leading to the massive abandonment of bottles that is currently being witnessed on a global scale.

2) Whereas, in an attempt to remedy the aforementioned loose-fit shortcomings of the aforementioned prong type of devices, certain other types of toting devices revert instead to utilizing elasticized parts as the means by which the necks of bottles are affixed to the toting device itself. However, these types of devices, although more universal in nature, still tend to be inherently cumbersome whenever a tensioned elasticized part is being either forced onto or otherwise is being forcibly removed from the recess which is commonly found just below the neck ring of a bottle, onto which the elasticized part is fitted. In addition, because the elasticized parts are subjected to stress induced wear it makes these components prone to failure after prolonged use. These shortcomings also render devices of this type to be less desirable to the consumer, which in turn also diminishes the environmental goals as well.

3) Further, with respect to those toting devices of the current art that utilize a mechanical closure clip to affix a bottle to an accoutrement, and/or a bottle to the clip itself, the shortcomings become even more amplified, since the operation of a mechanical clip;

a) fails to afford an individual with swift unencumbered access to the contents of a bottle;
b) typically need to be manually and thus awkwardly manipulated with both hands in order to either detach the bottle from an accoutrement, and/or the bottle from a mechanical clip, operations which are further compounded when the assembly and/or the bottle is subsequently being restored to its original toting position.

The present device however remedies all of the aforementioned shortcomings since the present device features;

a) an environmentally friendly pre-tensioned durable frame. A feature which encourages consumers to preserve the device for repeated use, thereby reducing and/or eliminating the amount of traditionally plastic toting devices from being purchased and potentially disintegrating in waterways and oceans.
b) a unique crisscrossing pincer clamping configuration which simply and readily self-adjusts to universally accommodate the various neck and neck ring diameters which exist within the vast realm of commercially manufactured beverage bottles.
c) simplified operational characteristics which are of great importance to those individuals who have the desire to tote hydration bottles while pursuing passive activities such as hiking, browsing, walking, or gathering, or who may be engaged in active occupations such as construction workers, warehouse workers, landscapers, charity walkers, police officers, military personnel, active homeowners, homemakers, field hands, FEMA recipients, and tourists alike, to name but a few examples of the greater hydrating population who would benefit from the more unique conveniences and environmental advantages the present device, being universal in nature, has to offer.

Further, with more than 140,000,000 personally sized plastic beverage bottles, of just the lesser neck diameter being purchased every day in the United States alone, an equal amount is being discarded accordingly, with a great many irresponsibly so, making the issue of discarded beverage bottles both a national problem and international problem.

As a result of these abandonments, and the similarly irresponsible discarding of personally sized plastic beverage bottles, an unwarranted environmental impact is being imposed on hiking trails, roadways, drainage systems, waterways, oceans, landfills, and wildlife. This is due in large part to the inconvenience an end user must endure when using just their hands while toting a disposable bottle once it has been either emptied, or otherwise partially emptied of its contents. However, by providing a small, reusable, moderately expensive, lightweight, hands-free toting device of universal application, most particularly with respect to the more common class of bottles of the lesser neck size, a commercially manufactured beverage container of a personal size, once either emptied, or partially emptied of its contents, can now be easily and conveniently toted to a proper disposal and/or recycling location, or it can be otherwise repurposed as a refillable container. This combination of convenience features, coupled with the simplified operational characteristics of the present device, both addresses and mitigates the pressing environmental issues concerning the errant disposal of used beverage bottles, most especially in light of the added benefit gained when producing the present reusable device from a non-floatable material.

In summation, by availing themselves of a simplified hands-free reusable device, consumers and lawmakers alike, are provided with an inexpensive convenience device for toting a commercially manufactured beverage bottle, most especially on public land. This promotes and encourages the reuse, recycling, and final proper disposal of a beverage bottle, since unlike devices of the current art, the present device allows for any personal water or beverage bottle, of virtually any classified neck size, to be swiftly and easily loaded, toted, accessed, mounted, removed, stowed, carried, slung, attached, detached, repositioned, replaced, refilled, repurposed, recycled, or otherwise just as easily rendered to a desk top, table top, or to a cup-holder environment, with each cited action being easily and swiftly performed by dexterous or impaired hands alike, in both the use and deployment of this environmentally correct and user friendly beverage bottle toting device.

DRAWING REFERENCE NUMERALS

Figure 1:
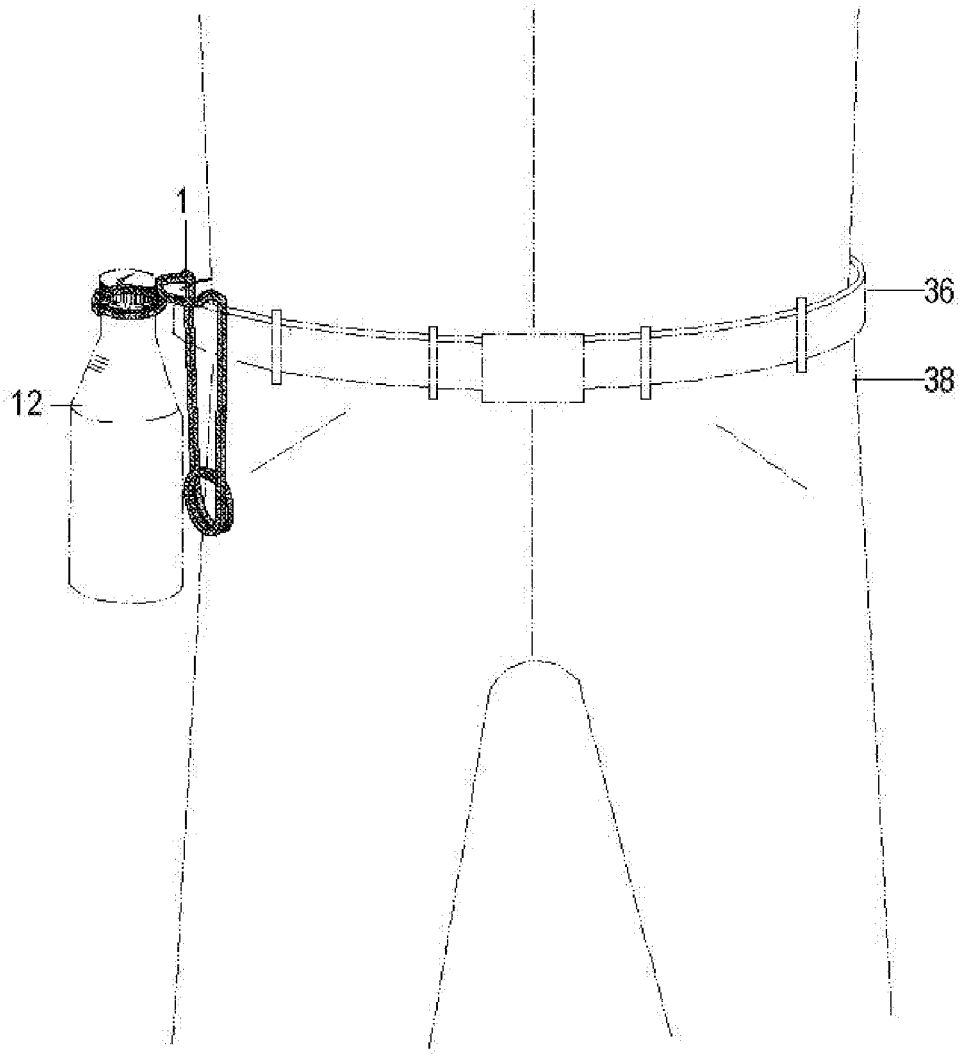
FIG. 1 An introductory perspective view depicting the present device as it would typically appear when temporarily affixed to an accoutrement of an end user while retaining a commercially manufactured beverage bottle.

1 inherently tensile tensioning frame
2 lower pincer arm
4 upper pincer arm
6 vertical tensioning strut associated with the upper pincer arm
8 vertical tensioning strut associated with the lower pincer arm
10 supplemental tensioning coil
12 typical commercially manufactured beverage bottle
14 bottle cap
16 neck ring common to a commercially manufactured beverage bottle
18 neck region of a commercially manufactured beverage bottle
19 centrally aligned receiving aperture
20 user applied force acting on upper pincer arm
22 user applied force acting on lower pincer arm
24 outwardly expanding directional attribute of lower pincer arm reacting to user applied force
26 outwardly expanding directional attribute of upper pincer arm reacting to user applied force
28 inherently induced outwardly thrusting tensile force
30 inherently induced outwardly thrusting tensile force
32 reactive compressive clamping force acting on lower pincer arm
34 reactive compressive clamping force acting on upper pincer arm
36 end user accoutrement
38 end user

DETAILED DESCRIPTION OF THE INVENTION

FIG. 1 An introductory perspective view depicting one manner in which the inherently tensile tensioning frame 1 can be utilized to retain, and temporarily affix, a commercially manufactured beverage bottle 12 to an accoutrement 36 of an end user 38.

Figure 2:
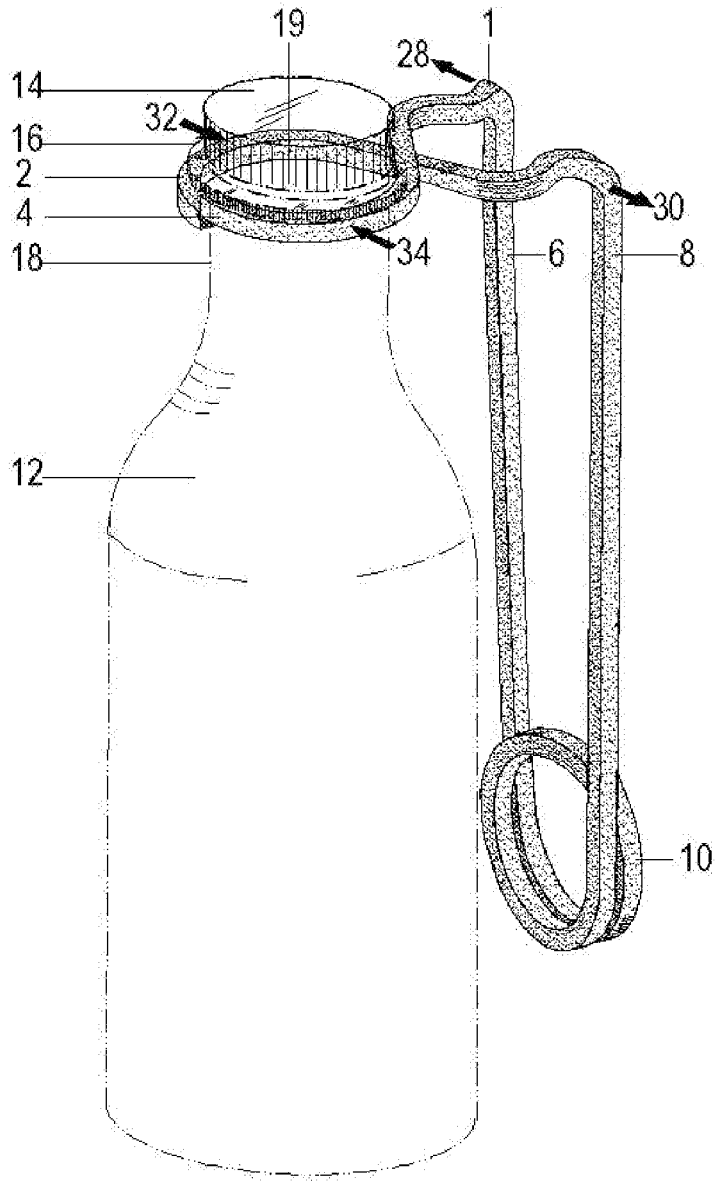
FIG. 2A perspective view of the present device as it would typically appear when retaining a commercially manufactured beverage bottle provided with a neck ring.

FIG. 2 An enlarged perspective view relative to FIG. 1 depicting an aperture 19 formed by the crisscrossing of the upper pincer arm 4 with the lower pincer arm 2 of the inherently tensile tensioning frame 1, wherein the activated crisscrossing feature relative to the pincer arms 4,2 supports, clamps, and retains a commercially manufactured beverage bottle 12 about its neck 18 in the region located below the bottle's neck ring 16 as a result of the opposing compressive forces 32 and 34 reacting inversely to the outwardly thrusting tensioning forces 28,30 inherent to both the vertically aligned upper and lower pincer arm struts 6,8 and the spring-like characteristics of a supplemental tensioning coil 10.

FIG. 3A side view perspective of the present device depicting the inherently tensile tensioning frame 1, the horizontally aligned upper pincer arm 4 and its associated vertically aligned tensioning strut 6, the horizontally aligned lower pincer arm 2 and its associated vertically aligned tensioning strut 8, and the supplemental tensioning coil 10, in each their respective unencumbered static state.

Figure 3:
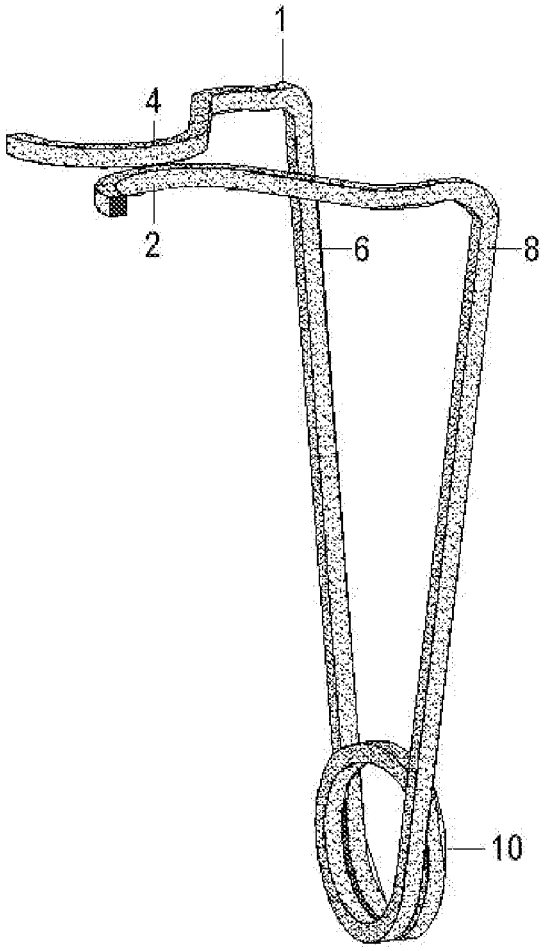
FIG. 3A perspective side view of the present device as it would appear unencumbered and in a static state.
Figure 4:
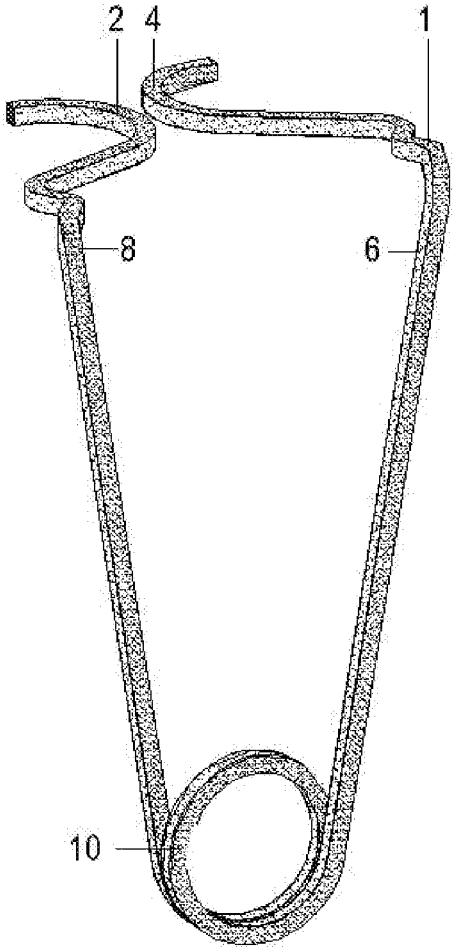
FIG. 4A perspective rearward view of the present device as it would appear unencumbered and in a static state.

FIG. 4A rearward perspective view relative to FIG. 3 depicting the inherently tensile tensioning frame 1, the horizontally aligned upper pincer arm 4 and its associated vertically aligned tensioning strut 6, the horizontally aligned lower pincer arm 2 and its associated vertically aligned tensioning strut 8, and the supplemental tensioning coil 10, in each their respective unencumbered static state.

FIG. 5A front view of the device depicting the inherently tensile tensioning frame 1 in an unencumbered static state.

Figure 6:
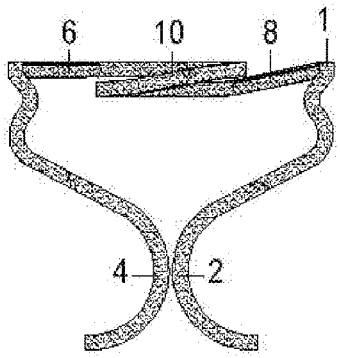
FIG. 6A top view of the present device, relative to FIG. 5, as it would appear unencumbered and in a static state.
Figure 5:
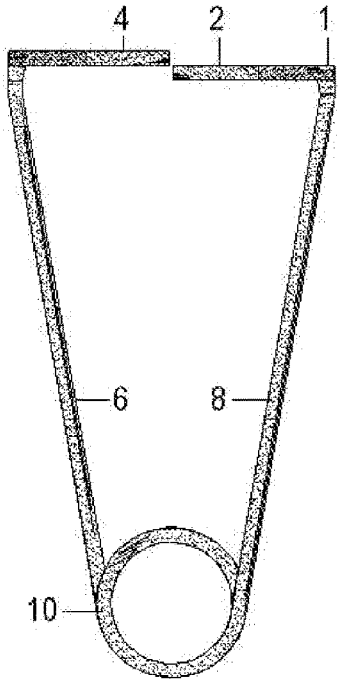
FIG. 5A front view of the present device as it would appear unencumbered and in a static state.

FIG. 6A top view of the device relative to FIG. 5 depicting the inherently tensile tensioning frame 1 in an unencumbered static state.

Figure 7:
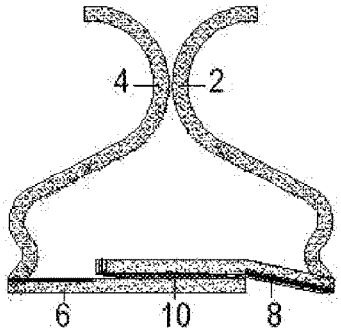
FIG. 7A bottom view of the present device, relative to FIG. 5, as it would appear unencumbered and in a static state.

FIG. 7A bottom view of the device relative to FIG. 5 depicting the inherently tensile tensioning frame 1 in an unencumbered static state.

FIG. 8A left side view of the device relative to FIG. 5 depicting the inherently tensile tensioning frame 1 in an unencumbered static state.

Figure 9:
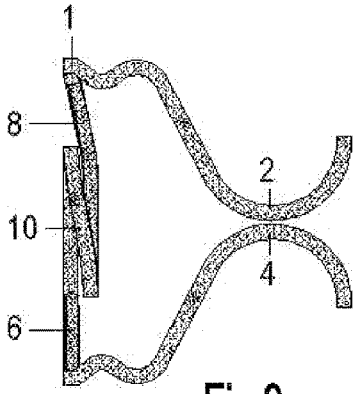
FIG. 9A top view of the present device, relative to FIG. 8, as it would appear unencumbered and in a static state.
Figure 8:
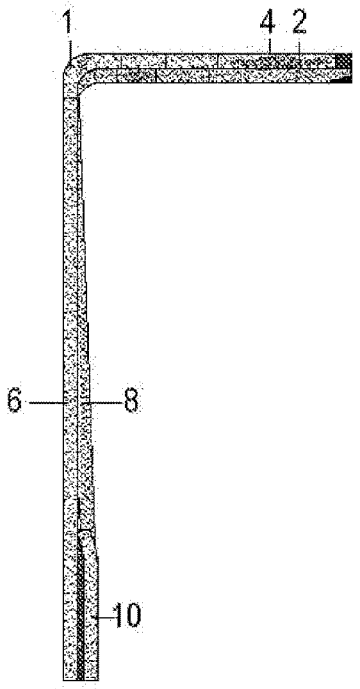
FIG. 8A left side view of the present device, relative to FIG. 5, as it would appear unencumbered and in a static state.

FIG. 9A top view of the device relative to FIG. 8 depicting the inherently tensile tensioning frame 1 in an unencumbered static state.

FIG. 10A right side view of the device relative to FIG. 5 depicting the inherently tensile tensioning frame 1 in an unencumbered static state.

Figure 11:
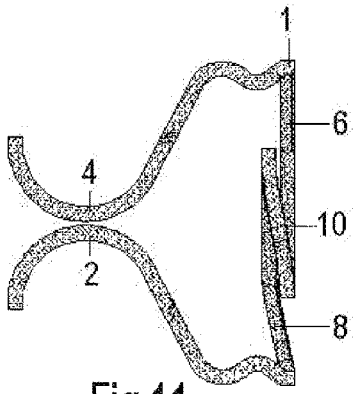
FIG. 11A top view of the present device, relative to FIG. 10, as it would appear unencumbered and in a static state.
Figure 10:
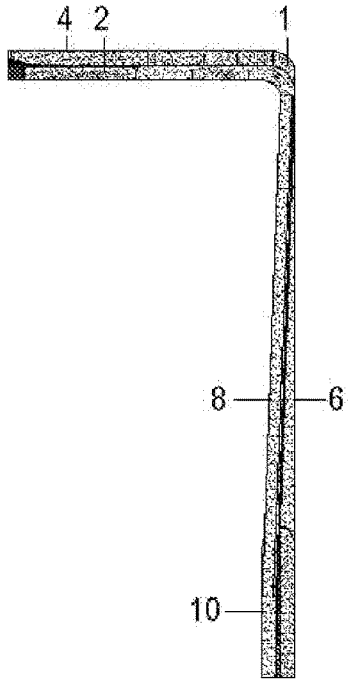
FIG. 10 A right side view of the present device, relative to FIG. 5, as it would appear unencumbered and in a static state.

FIG. 11A top view of the device relative to FIG. 10 depicting the inherently tensile tensioning frame 1 in an unencumbered static state.

Figure 12:
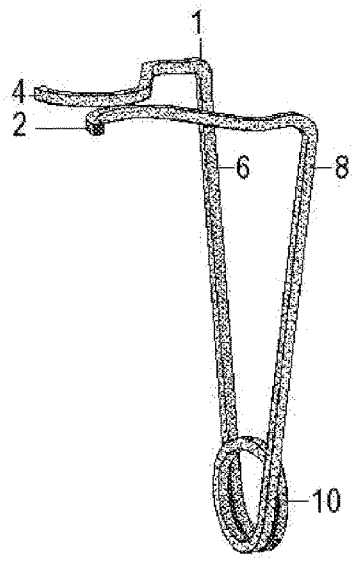
FIG. 12 The first in a series of three progressive perspective side views of the present device depicted here unencumbered and in a static state.

FIG. 12 As the first in a series of three progressive perspective views this illustration depicts the inherently tensile tensioning frame 1 in an unencumbered static state.

Figure 13:
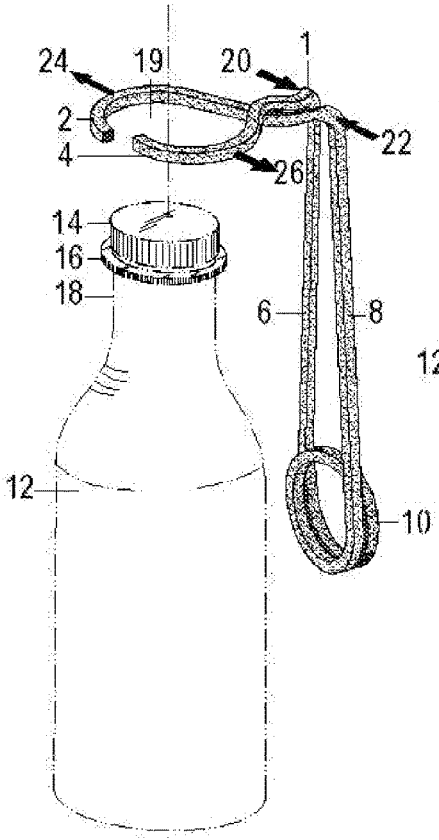
FIG. 13 The second in a series of three progressive perspective side views of the present device; depicting here the manner in which opposing external forces applied to the vertical tensioning struts of the tensioning frame causes the crisscrossing pincer mechanism, and therefore the central aperture so formed, to expand maximally outward in preparation of receiving the neck region of a commercially manufactured beverage bottle.

FIG. 13 As the second in a series of three progressive perspective views; this illustration depicts the manner in which the cap 14, neck ring 16, and neck 18, of a commercially manufactured beverage bottle 12 is centrally aligned with the outwardly expanding 24,26 receiving aperture 19 which is inversely produced by the activated crisscrossing configuration of the upper and the lower pincer arms 4,2 reacting to the external squeezing forces 20,22 being simultaneously applied by an end user to the vertical tensioning struts 6,8 of the inherently tensile tensioning frame 1.

Figure 14:
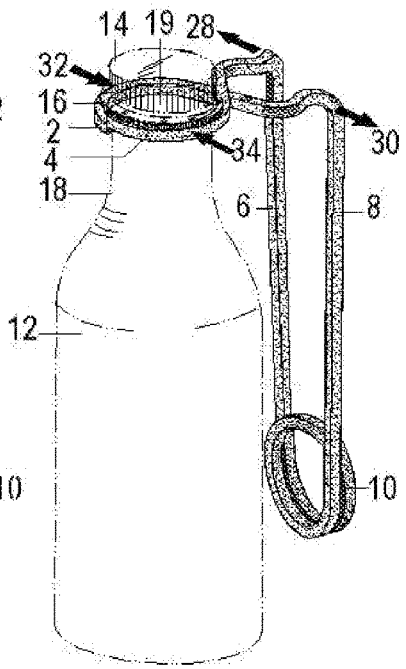
FIG. 14 The third in a series of three progressive perspective side views of the present device; depicting here the manner in which the opposing compressive forces inherent to the self-adjusting crisscrossing pincer mechanism serves to support, clamp, and retain the neck of a commercially manufactured bottle by gripping the bottle at a point below its neck ring when the tensioning frame is in its operational toting state.

FIG. 14 As the third in a series of three progressive perspective views; this illustration depicts the manner in which the neck 18 and neck ring 16 of a commercially manufactured beverage bottle 12, after having passed through the activated receiving aperture 19, is subsequently supported and retained within the confines of the inherently tensile tensioning frame 1 by the compressive clamping forces 32,34 produced by the activated crisscross configuration of the upper and lower pincer arms 4,2 as an inverse reaction to the outwardly thrusting tensile forces 28,30 inherent to both the vertical struts 6,8 and a supplemental tensioning coil 10.

Figure 15:
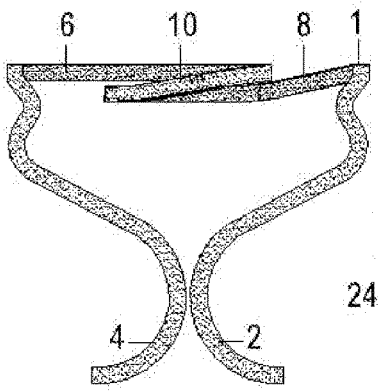
FIG. 15 The first in a series of three progressive top views of the present device; depicted here as it would appear unencumbered and in a static state relative to FIG. 12.

FIG. 15 As the first in a series of three progressive top views of the device; this illustration depicts the inherently tensile tensioning frame 1 in an unencumbered static state.

Figure 16:
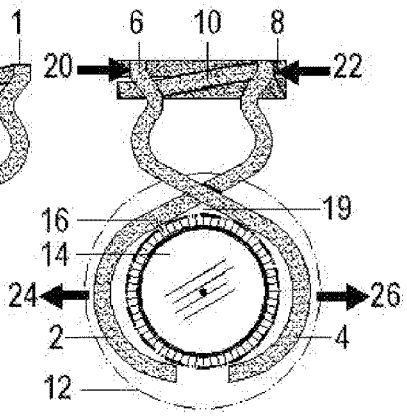
FIG. 16 Relative to FIG. 13 this illustration is the second in a series of three progressive top views of the present device; depicting here the manner in which opposing external forces applied to the vertical tensioning struts of the tensioning frame causes the crisscrossing pincer mechanism, and therefore the central aperture so formed, to expand maximally outward in preparation of receiving the neck region of a commercially manufactured beverage bottle.

FIG. 16 As the second in a series of three progressive top views, and relative to FIG. 13; this illustration depicts the manner in which the cap 14 and neck ring 16 of a commercially manufactured beverage bottle 12 is centrally aligned with the outwardly expanded 24,26 receiving aperture 19 produced via the crisscross configuration relative to the upper and the lower pincer arms 4,2 reacting to the external squeezing forces 20,22 being simultaneously applied by an end user to the vertical tensioning struts 6,8 of the inherently tensile tensioning frame 1.

Figure 17:
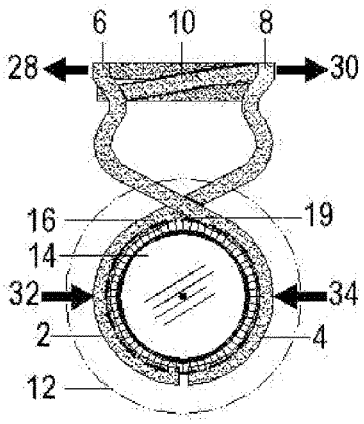
FIG. 17 Relative to FIG. 14 this illustration is the third in a series of three progressive top views of the present device; depicting here the manner in which the resultant tensile forces, inherent to the tensioning frame, inversely act through the self-adjusting crisscrossing pincer mechanism to ultimately support, clamp, and retain a commercially manufactured bottle within the confines of the device when the tensioning frame is in its operational toting state.

FIG. 17 As the third in a series of three progressive top views, and relative to FIG. 14; this illustration depicts the manner in which the neck 18 and neck ring 16 of a commercially manufactured beverage bottle 12, after having passed through the maximally expanded receiving aperture 19, is subsequently supported and retained within the confines of the inherently tensile tensioning frame 1 by the opposing compressive clamping forces 32,34 which are inversely produced via the crisscross configuration of the pincer arms 4,2 reacting to the outwardly thrusting tensile forces 28,30 inherent to the tensioned vertical struts 6,8 and the supplemental tensioning coil 10 of the inherently tensile tensioning frame 1.

CONCLUSIONS, RAMIFICATIONS, AND SCOPE

The reader will see that I have provided an improved hands-free device for toting a wide range of commercially manufactured beverage bottles of a personal size that:

a. is of universal application.
b. is environmentally necessary.
c. is easily made from a non-floatable material.
d. is easily toted hands-free either when either loaded or unloaded.
e. self-promotes the recycling and/or the reuse of commercially manufactured plastic bottles, most especially for the most commonly manufactured plastic bottles of the lesser neck size.
f. is reusable, therefore is cost effective.
g. is practical.
h. is durable.
i. is of a simple and compact design.
j. is easy to make.
k. is inexpensive.
l. is easy to load and/or unload for all age groups and for those with impaired hand abilities.
m. is easy to stow away when in an unloaded static condition.
n. is embodied with features which allow the user to take advantage of other added conveniences such as when placing the assembled device, when loaded and inverted, on a hook or other locally convenient protuberance.

I claim:

1. A self-adjusting pincer mechanism for toting a beverage bottle of a personal size;

wherein said self-adjusting pincer mechanism is an aspect of an inherently tensile frame, wherein said tensile frame is comprised of a horizontal and a vertical component;

wherein said vertical component of said tensile frame is comprised of two inherently tensile struts, wherein the lower extremity of said tensile struts are contiguous, wherein said horizontal component of said tensile frame is comprised of two independent curvilinear arms, wherein each said curvilinear arms are respectively contiguous with the upper extremity of a corresponding tensile strut of said vertical component, wherein said curvilinear arms of said horizontal component project symmetrically outward in the same direction from each respective corresponding tensile strut of said vertical component, wherein the top plane of one curvilinear arm of said horizontal component lies at the bottom plane of the other curvilinear arm of said horizontal component, wherein the outermost extremity of each said curvilinear arm of said horizontal component are symmetrically configured with a horizontal hook for the purpose of grasping the neck of a beverage bottle, wherein compressive forces externally applied to said tensile struts causes said lower curvilinear arm to pass beneath and subsequently crisscross with said upper curvilinear arm of said horizontal component, wherein said horizontal hook configurations of said criss-crossing curvilinear arms form a centrally aligned outwardly expanded symmetrical aperture of sufficient magnitude to receive the neck of a bottle, wherein said crisscrossed curvilinear arms of said outwardly expanded centrally aligned aperture subsequently retract around said received neck of said bottle when said forces, externally applied to said tensile struts of said vertical component, are abated, wherein the tensile forces inherent to said vertical struts of said vertical component act inversely through said symmetrical hook configurations of said retracted criss-crossed curvilinear arms of said horizontal component to support, clamp, and retain a beverage bottle about its neck within the confines of said centrally aligned aperture of said horizontal component of said self-adjusting pincer mechanism.

2. The self-adjusting pincer mechanism of claim 1;

wherein the lower extremity of said tensile vertical struts are contiguous and coiled.

* * * * *